US006487815B2

(12) United States Patent
Rimback

(10) Patent No.: US 6,487,815 B2
(45) Date of Patent: Dec. 3, 2002

(54) ADJUSTABLE PROTECTIVE PLATFORM FOR SUPPORTING POTTED PLANTS

(75) Inventor: Peter D. Rimback, Euclid, OH (US)

(73) Assignee: Hanover Direct, Inc., Weehawken, NJ (US)

( * ) Notice: Subject to any disclaimer, the term of this patent is extended or adjusted under 35 U.S.C. 154(b) by 94 days.

(21) Appl. No.: 09/754,436

(22) Filed: Jan. 4, 2001

(65) Prior Publication Data

US 2001/0049904 A1 Dec. 13, 2001

Related U.S. Application Data

(60) Provisional application No. 60/201,030, filed on May 1, 2000.

(51) Int. Cl.[7] ..... A01G 17/14
(52) U.S. Cl. ..... 47/44
(58) Field of Search ..... 47/33, 39, 46, 47/71; 248/149

(56) References Cited

U.S. PATENT DOCUMENTS

| | | | | | |
|---|---|---|---|---|---|
| 440,141 | A | * | 11/1890 | Dearborn | 47/33 |
| 986,395 | A | * | 3/1911 | King | 211/126.3 |
| 5,406,745 | A | * | 4/1995 | Lin | 404/41 |
| D444,113 | S | * | 7/2001 | Rimback | D11/155 |
| D445,061 | S | * | 7/2001 | Rimback | D11/143 |
| D445,359 | S | * | 7/2001 | Rimback | D11/155 |

OTHER PUBLICATIONS

Photographs of "Sheer Garden Deck Protector".

* cited by examiner

*Primary Examiner*—Charles T. Jordan
*Assistant Examiner*—Francis T. Palo
(74) *Attorney, Agent, or Firm*—Thompson Hine LLP

(57) ABSTRACT

An adjustable protective platform for supporting, for example, potted plants includes a plurality of multi-legged links. Each link includes a pair of linkage legs angled with respect to each other at an acute angle. Each linkage leg includes a plurality of projections extending from the upper and lower surfaces and at least two transverse slots cut into the upper surface, extending from the outer side to the inner side, and angled at least partially towards the origin end of the opposite linkage leg. The slots in each linkage leg are symmetrical with respect to the slots in the opposite linkage leg. Therefore, the links are coupled together by arranging the links in an alternating up and down (one link facing up and the next facing down) fashion forming an outer enclosed loop, and further, by engaging a slot in a linkage leg of an upward facing link with a slot in an immediately adjacent linkage leg of an adjacent downwardly facing link. When the outermost slots of the linkage legs are engaged with each other, the size of the protective platform is maximized. Likewise, when the innermost slots of the linkage legs are engaged with each other, the size (diameter) of the assembled platform is minimized.

19 Claims, 12 Drawing Sheets

ADJUSTABLE PROTECTIVE PLATFORM FOR SUPPORTING POTTED PLANTS

CROSS-REFERENCE TO RELATED APPLICATIONS

The present application claims priority under 35 U.S.C. §119 from U.S. Provisional Patent Application, Ser. No. 60/201,030, filed May 1, 2000, the entire disclosure of which is incorporated herein by reference.

BACKGROUND

The present invention is related to protective platforms for elevating objects, such as potted plants, from wooden porches or decks, and more specifically, to an adjustable protective platform made up of a plurality of interlocking links.

L. B. Plastics, Inc. of Mooreville, N.C. manufactures and sells a product known as a SHEERGARDEN deck protector. The SHEERGARDEN deck protector is a circular platform for elevating potted plants slightly above the surface of a wooden deck and has a plurality of cutouts extending therethrough so as to promote the flow of air between the deck and the potted plant. A disadvantage with the SHEERGARDEN deck protector is that it is not adjustable in size, which does not permit it to be easily hidden under the potted plant if desired.

SUMMARY

The present invention provides an adjustable protective platform for elevating objects, such as potted plants, from patios, porches, decks, or the like. In elevating the objects, the present invention provides support for the object, aerates the object if necessary and reduces water damage on the patio surface. The present invention is adjustable in that the user can adjust the area of the platform to correspond to the size of the object(s) being supported. To be fully adjustable, the present invention comprises a plurality of interlocking links.

Accordingly, one aspect of the present invention provides for an adjustable protective platform for supporting, for example, potted plants. The platform comprises a plurality of multi-legged links. Each link includes a pair of linkage legs angled with respect to each other at an acute angle. Each linkage leg includes a plurality of projections extending from the upper and lower surfaces and at least two transverse slots cut into the upper surface, extending from the outer side to the inner side, and angled at least partially towards the origin end of the opposite linkage leg. The slots in each linkage leg are symmetrical with respect to the slots in the opposite linkage leg. Therefore, the links are coupled together by arranging the links in an alternating up and down (one link facing up and the next facing down) fashion forming an outer enclosed loop, and further, by engaging a slot in a linkage leg of an upward facing link with a slot in an immediately adjacent linkage leg of an adjacent downwardly facing link. When the outermost slots of the linkage legs are engaged with each other, the size of the protective platform is maximized. Likewise, when the innermost slots of the linkage legs are engaged with each other, the size (diameter) of the assembled platform is minimized.

Preferably, each link also includes at least one additional leg extending from the origin between the pair of linkage legs, where each additional leg includes a plurality of projections extending from its upper and lower surfaces. This additional linkage leg provides additional support to the potted plant when positioned on the assembled platform. s It is a further aspect of the invention to provide an adjustable protective platform for supporting and aerating, for example, potted plants. The platform comprises at least two links. Each link includes at least two outer linkage legs joined together by a base portion. Each outer linkage leg includes at least one fastener for coupling to an immediately adjacent outer linkage leg of an adjacent link. Thus, the links may be arranged with respect to one another and linked together such that each linkage leg is coupled to an immediately adjacent linkage leg of adjacent link resulting in the outer linkage legs forming an outer enclosed loop for supporting the object thereupon. Preferably, each linkage leg includes at least two of the fasteners, where a first one of the fasteners is relatively proximal to the origin while a second one of the fasteners is relatively distal from the origin. With such an arrangement, the first fasteners may be used to couple the links together to provide a loop having a smaller diameter and the second fasteners may be used to couple the links together to provide a loop having a relatively larger diameter.

Preferably, the fasteners are slots cut into the upper surface of each linkage leg, extending from the outer side surface to the inner side surface. It is also preferred that the slots in each linkage leg are symmetrical with respect to the slots in the opposite linkage leg. With such a fastener design, the links are coupled together by arranging the links in an alternating up and down fashion so that the linkage legs form an outer enclosed loop via mutual interfacing of the slot in a linkage leg of an upwardly facing link with the slot in an immediately adjacent linkage leg of an adjacent downwardly facing link. It is also preferred that the slots include symbols representing the relative size of the adjustable protective platform that would be provided if the slots were used to couple the links together.

It is also preferred that each link includes at least one support leg extending from the base portion between the at least two linkage legs. Preferably, each support leg includes a plurality of projections extending from its upper and lower surfaces. Each support leg may also include scribe lines either etched or molded into the lateral surfaces thereof and located nearest the outer end of each support leg, where such scribe lines are designed to allow the user to permanently detach the outer end of each support leg when a smaller area is desired for the platform. Each linkage leg may include such scribe lines either etched or molded into the inner and outer side surfaces of each linkage leg and located nearest the outer end of each linkage leg, where such scribe lines are designed to allow the user to permanently detach the outer end of each linkage leg when a smaller area is desired for the platform.

Preferably, each linkage leg includes a plurality of projections extending from the upper and lower surfaces. Preferably, the plurality of projections extending from the upper surface are cylindrical in shape while the plurality of projections extending from the lower surface are quadrilateral in shape.

It is a further aspect of the invention to provide for a link of an adjustable protective platform for supporting and aerating, for example, potted plants. The link comprises a base portion and at least two elongated linkage legs. The base portion includes an upper surface, a lower surface, an outer side surface, an inner side surface, and two ends. The base portion is substantially curved towards the inner side so as to form an arc. The linkage legs include a plurality of evenly spaced projections extending from the upper surface between the plurality of evenly spaced slots; and a plurality of evenly spaced projections extending from the lower surface. The linkage legs are used to couple a plurality of links together by arranging the links in an alternating up and down fashion so that the linkage legs form an outer enclosed loop via mutual interfacing of the slot in a linkage leg of an upwardly facing link with the slot in an immediately adjacent linkage leg of an adjacent downwardly facing link.

It is also preferred that the pair of linkage legs are angled at approximately 60° with respect to one another from the base portion and the slots are angled at approximately 60° from a centerline extending between the two linkage legs.

Preferably, the link further comprises at least one elongated support leg extending from the base portion between the two linkage legs and includes a plurality of evenly spaced cylindrical projections extending from the upper and lower surfaces.

Preferably, the at least two elongated linkage legs and the support leg include a scribe line either etched or molded into both the inner and outer side surfaces thereof, where these scribe lines are located near the outer end and designed to allow the user to permanently detach an outer end segment of the associated leg, thereby creating a smaller leg.

A further aspect of the present invention provides a method for adjusting the support area of a platform for supporting and aerating, for example, potted plants. The method comprises the steps of (a) providing at least two links, where each link includes a pair of linkage legs extending from an origin portion of the link, each linkage leg including at least two transverse slots, (b) arranging the links in an alternating up and down fashion, (c) overlapping the linkage leg of an upwardly facing link with the linkage leg of an immediately adjacent downwardly facing link at a point that will create the desired area for the platform (i.e. the closer to the base of the link that the overlapping occurs, the smaller the resulting area will be), (d) ensuring that overlapping linkage legs are fastened together via the mutual interfacing of the symmetrical slots located on each linkage leg, and (e) repeating steps (b) through (d) until all of the links are fastened together via the linkage legs to form an outer enclosed loop.

A further aspect of the present invention provides an additional method for adjusting the support area of a platform for supporting and aerating, for example, potted plants. The method comprises the steps of (a) providing at least two links made from a resilient material, where each link includes a pair of linkage legs extending from an origin portion of the link at approximately 60° with respect to one another, each linkage leg including at least two transverse slots angled at approximately 60° from a centerline extending between the two linkage legs, (b) arranging the links in an alternating up and down fashion, (c) overlapping the linkage leg of an upwardly facing link with the linkage leg of an immediately adjacent downwardly facing link at a point that will create the desired area for the platform (i.e. the closer to the base of the link that the overlapping occurs, the smaller the resulting area will be), (d) lightly squeezing the outer ends of the linkage legs inward, (e) ensuring that overlapping linkage legs are fastened together via the mutual interfacing of the symmetrical slots located on each linkage leg, (f) releasing the outer ends of the linkage legs thereby creating a holding tension in the links due to the elasticity of the resilient material, and (g) repeating steps (b) through (f) until all of the links are fastened together via the linkage legs to form an outer enclosed loop.

DETAILED DESCRIPTION

Figure 1:
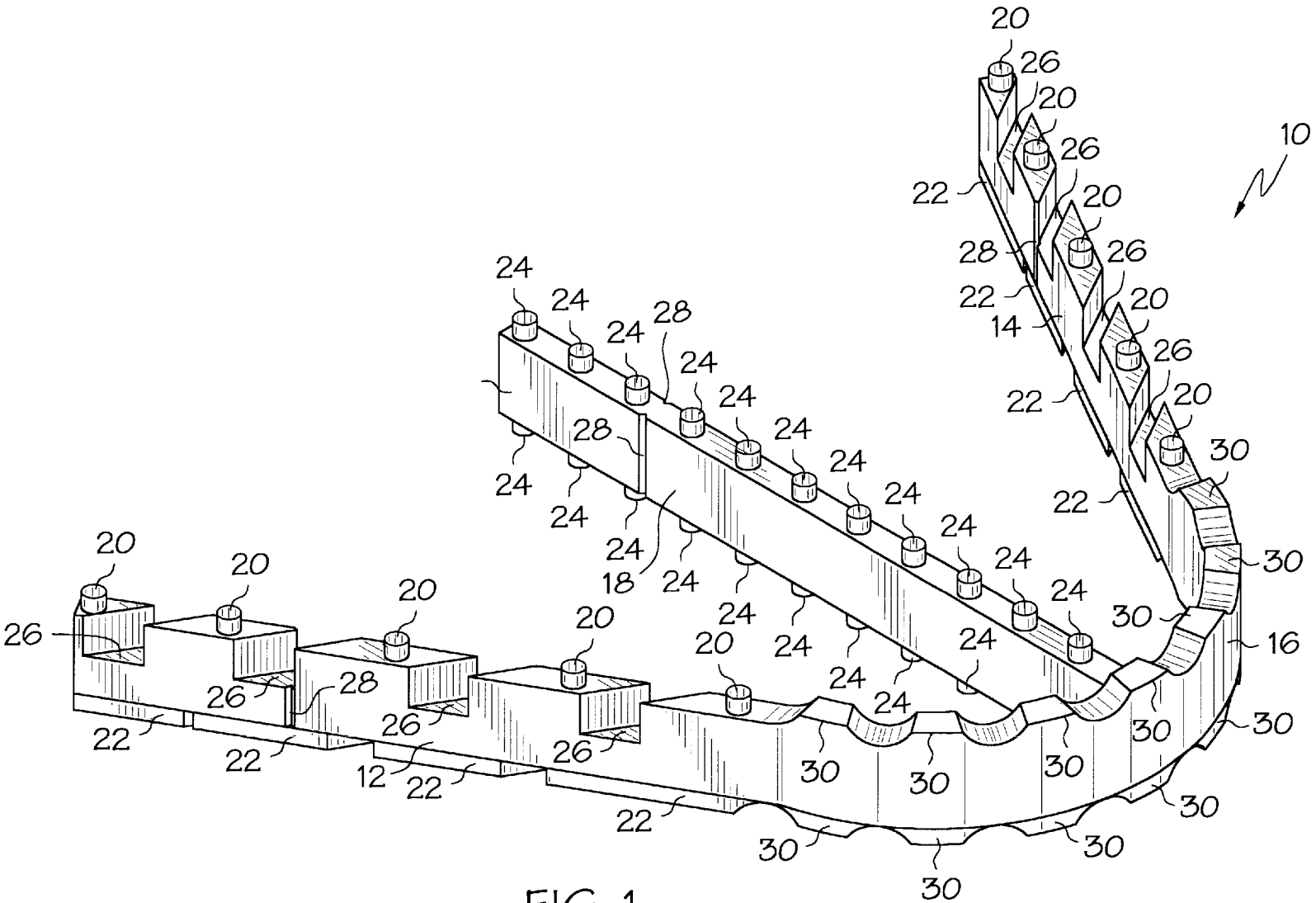
FIG. 1 illustrates a perspective view of a single link of the adjustable platform according to a preferred embodiment of the present invention.

FIG. 1 shows a single multi-legged link 10 according to a preferred embodiment of the present invention. The link is preferably molded from a plastic material, which is preferably polypropylene. Of course, it will be appreciated that the link may be made from other suitable materials and still fall within the scope of the invention. The link 10 includes a pair of linkage legs 12, 14 angled with respect to each other at approximately a 60-degree angle and integrally coupled to a substantially curved base portion 16 at their origin ends. Preferably, each linkage leg is about 85 mm in length. A third support leg 18, preferably, measuring about 90 mm in length, also extends from the curved base portion 16 midway between the two linkage legs 12, 14.

Each of the linkage legs 12, 14 include a plurality of cylindrical projections 20 extending from an upper surface thereof and spaced evenly therealong and a plurality of quadrilateral projections 22 extending from a lower surface thereof and arranged uniformly therealong. The support leg 18 also includes a plurality of cylindrical projections 24 extending from the upper and lower surfaces thereof and distributed uniformly therealong. Preferably, the cylindrical projections 20, 24 and the quadrilateral projections 22 have a height of about 2 mm.

Figure 7A:
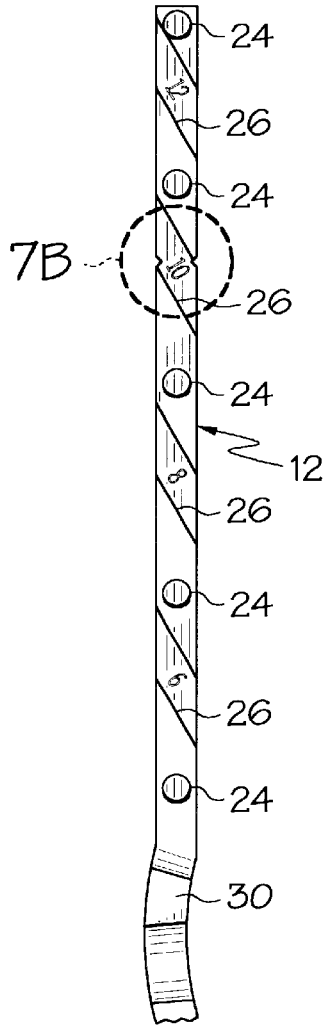
FIG. 7A provides a top plan view of a linkage leg of the link of FIG. 1.
Figure 7B:
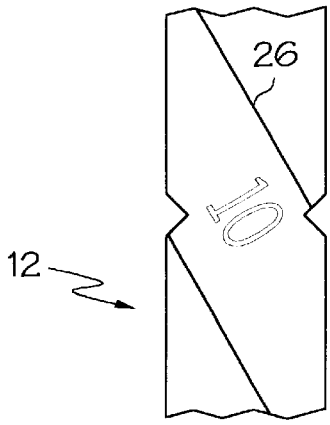
FIG. 7B provides a magnified view of the area identified as 7B in FIG. 7A.

Referring to FIGS. 1, 7A and 7B, each of the linkage legs 12, 14 also includes a plurality of transverse slots 26 cut into the upper surfaces thereof, extending diagonally towards the origin end from the outer side to the inner side of the linkage leg. Preferably, the transverse slots 26 will be cut at an angle that is approximately 60 degrees from the support leg 18 (i.e., the centerline extending between each of the linkage legs). Preferably, each slot 26 includes a number stamped therein that is visible by a user (see FIG. 7B). This number indicates to the user the size of the platform that would be created if this slot were used for all the links engaging with one another to create the assembled platform. For example, in the preferred embodiment, the outermost slot includes the number "12" (corresponding to a 12-inch diameter platform), the next innermost slot includes the number "10" (corresponding to a 10-inch diameter platform), the next innermost slot includes the number "8" (corresponding to an 8-inch diameter platform), and the innermost slot includes the number "6" (corresponding to a 6-inch diameter platform).

Scribe lines 28 are etched or molded into the lateral side surfaces of each leg and are located approximately in the last third region of the legs. These scribe lines are designed to allow the user to break off these end portions of the legs at the scribe lines when the links are to be assembled to create platforms of the smaller diameters. This may be necessary in certain embodiments because, otherwise, the legs of all the assembled pieces will interfere with each other to prevent assembly in these minimum configurations.

The curved base portion 16 also includes a plurality of projections 30 extending from its upper and lower surfaces. Preferably, the projections 30 have a height of about 2 mm.

Figure 2:
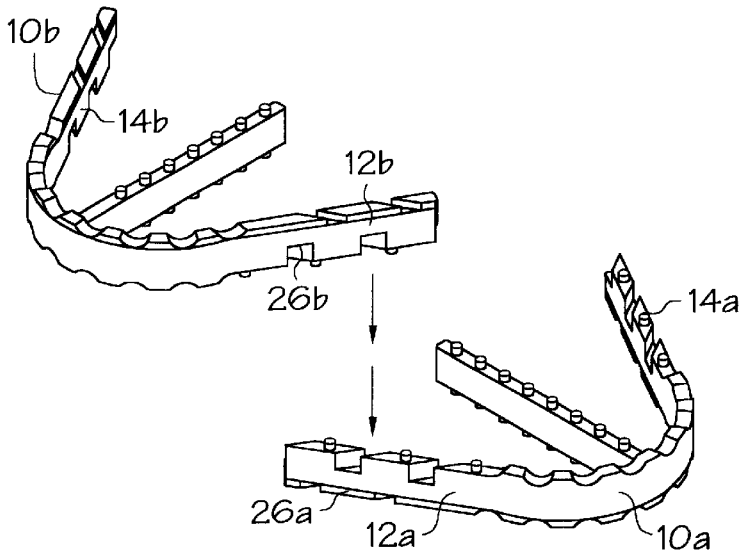
FIG. 2 illustrates a perspective view of an assembly step of the adjustable platform according to the preferred embodiment.
Figure 3:
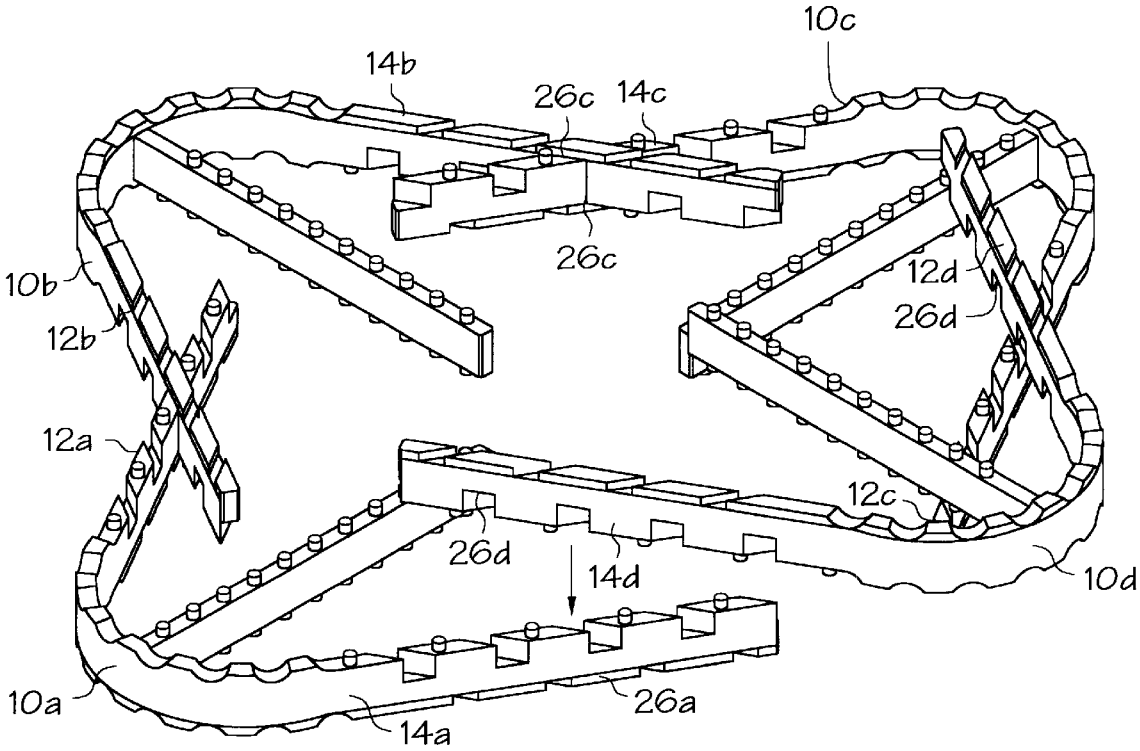
FIG. 3 illustrates a perspective view of another assembly step of the adjustable platform according to the preferred embodiment.

As shown in FIGS. 2 and 3, a platform is assembled by arranging the links in an alternating upward facing and downward facing fashion so that the linkage legs 12, 14, form an outer enclosed loop. Referring to FIG. 2, the slot 26*a* in a linkage leg 12*a* of an upward facing link 10*a* will be engaged with a similarly numbered slot 26*b* in an immediately adjacent linkage leg 12*b* of an adjacent downwardly facing link 10*b*. Referring now to FIG. 3, the next upwardly facing link 10*c* will be coupled to the downwardly facing link 10*b* by engaging the slot 26*c* in linkage leg 14*c* with the slot in linkage leg 14*b*. Finally, the last downwardly facing link 10*d* will be coupled between the two upwardly facing links 10*a* and 10*c* by engaging the slot 26*d* in linkage leg 12*d* with slot 26*c* in linkage leg 12*c*, and by engaging slot 26*d* in linkage leg 14*d* with slot 26*a* in linkage leg 14*a*.

The links 10*a*, 10*b*, 10*c* & 10*d* hold together, one to the other, by a friction fit in the slots and also, to some degree, by tension created in the plastic components when the parts are joined together as a unit of four pieces. In the preferred embodiment, the individual link 10 is designed so that it is necessary to lightly squeeze the outer ends of the linkage legs 12, 14 inward in order to be joined together in the four components. This creates a holding tension in the links due to the elasticity of the plastic. As will be understood by those of ordinary skill in the art, with this preferred embodiment, it may not be desirable to design the links so that too much bending would be required, for that could cause the plastic to bend too much, i.e., past its limits, and thus make a "set." If the plastic takes a "set," it may not produce sufficient holding tension.

When the platform is assembled in the manner described above, the projections 20, 22, 24 and 30, in combination with the spaces between the legs 12, 14 & 18, allow air and moisture to pass beneath or over the assembled platform when it is placed on supporting surface, such as a porch deck, and when a potted plant is placed on the upper surface of the assembled platform.

Figure 4:
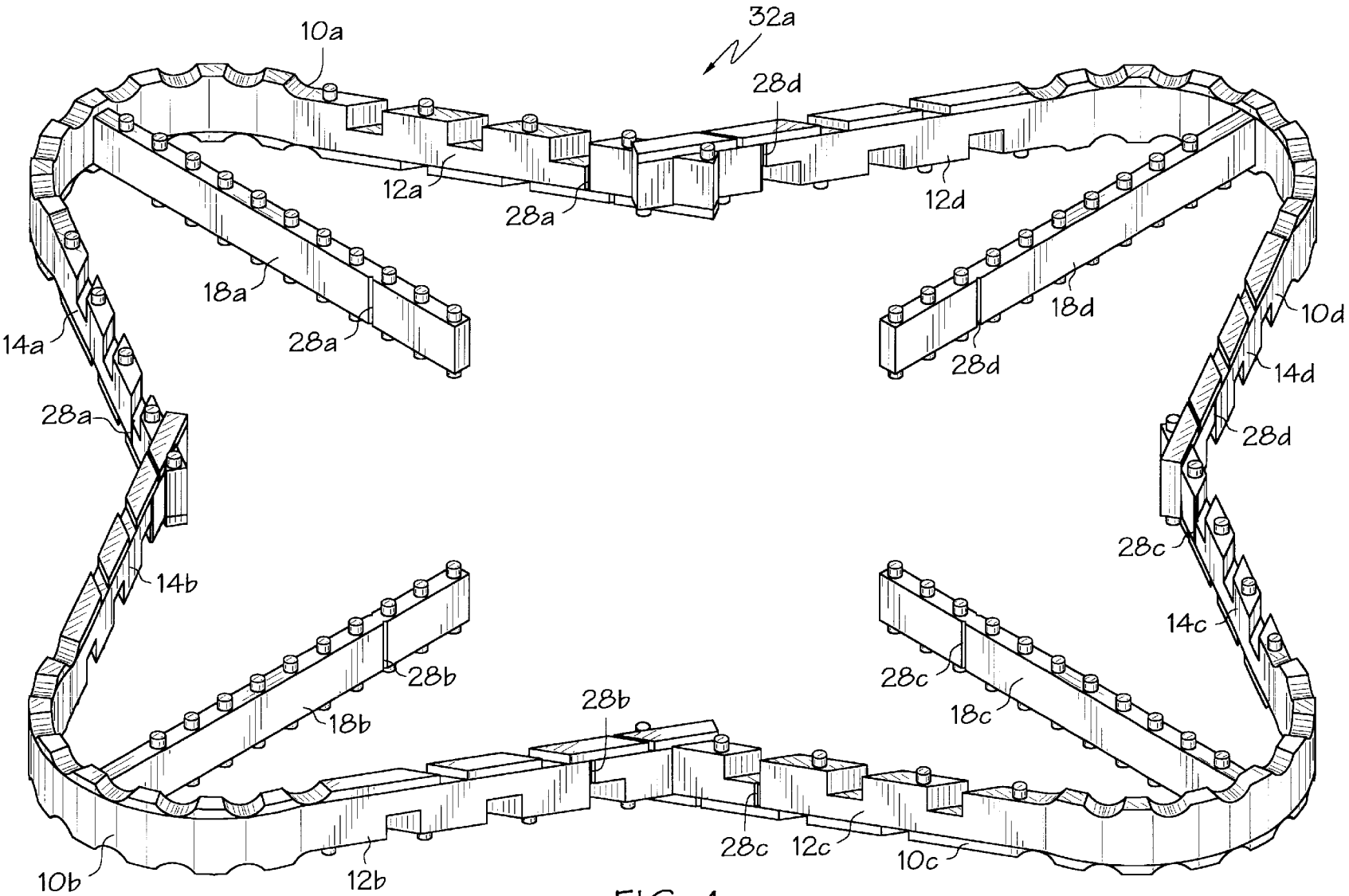
FIG. 4 illustrates a perspective view of an assembled platform according to the preferred embodiment, having a relatively larger diameter.
Figure 5:
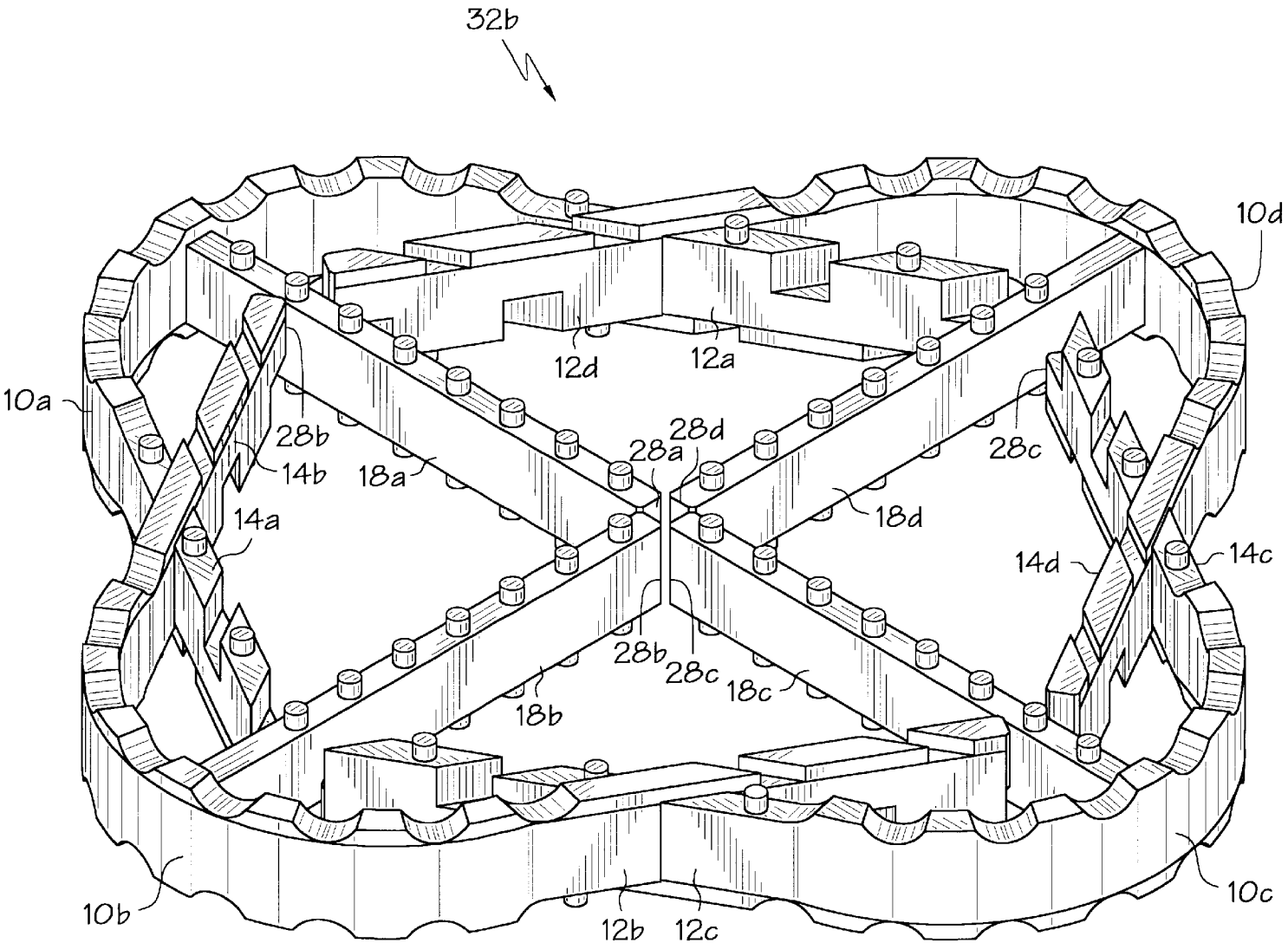
FIG. 5 illustrates a perspective view of an assembled platform according to the preferred embodiment, having a relatively smaller diameter.
Figure 6:
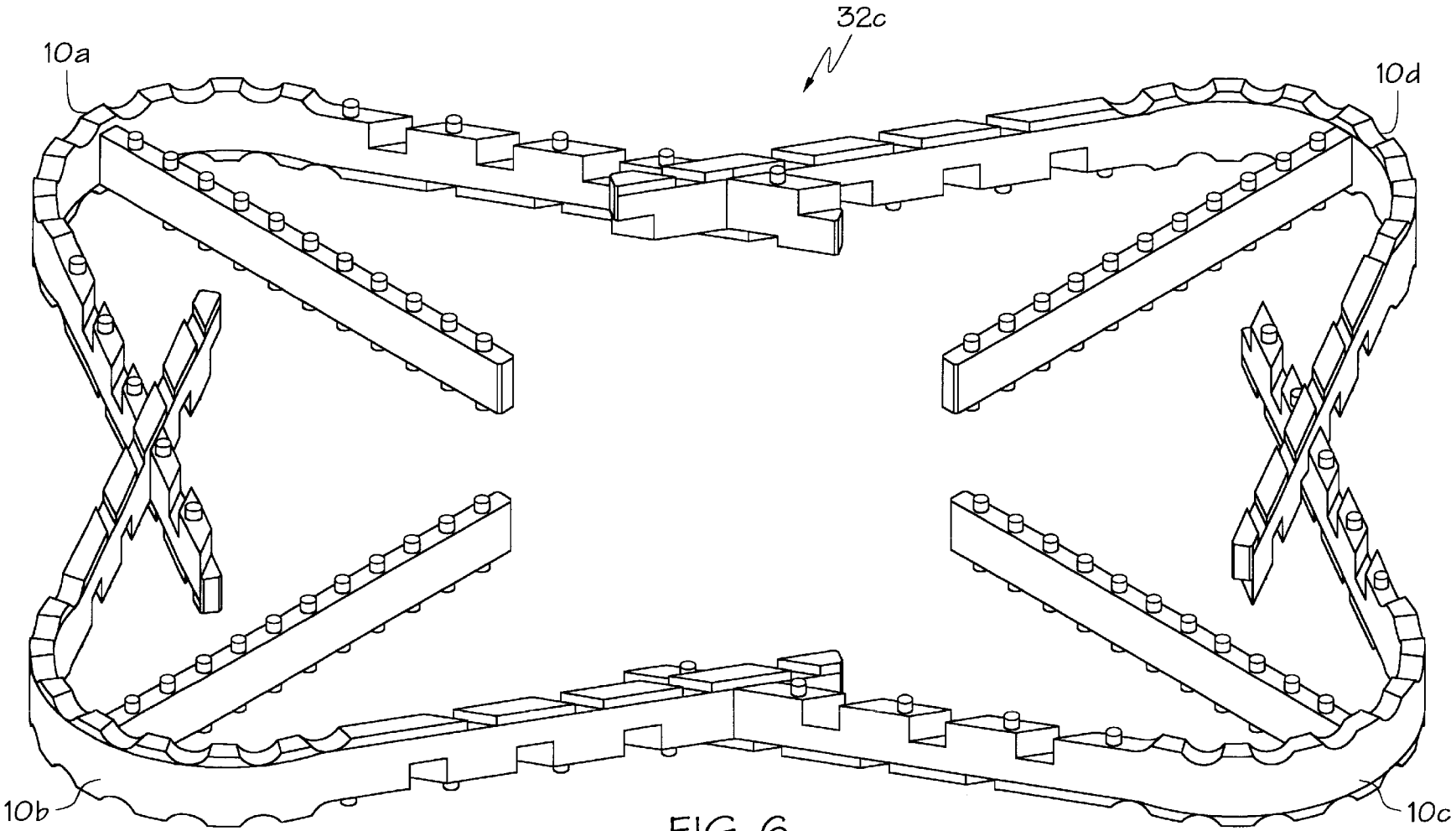
FIG. 6 illustrates a perspective view of an assembled platform according to the preferred embodiment, having an oblong configuration.

FIG. 4 illustrates an assembled platform 32*a*, where the links 10*a*–10*d* have been assembled together at their maximum diameter. FIG. 5 illustrates an assembled platform 32*b*, where the links 10*a*–10*d* have been assembled together in their minimum diameter (note that the ends of the legs 12, 14 & 18 have been removed at the scribe lines 28 to provide clearance for this assembly of the platform). Finally, FIG. 6 illustrates an assembled platform 32*c*, where the links 10*a*–10*d* have been assembled together in an oblong-type orientation. With this oblong arrangement, for example, the numbers "12"—"12" and "8"—"8" correspond to the engaging slot numbers of the coupled linkage legs used to create this configuration. It will be understood by those of ordinary skill in the art that many different symmetric and oblong configurations are achievable by using the preferred embodiment.

It will be appreciated by those of ordinary skill in the art that, while the preferred embodiment of the present invention is designed to utilize four substantially identical links 10 to create an assembled platform, the links may also be easily modified to allow for the use of different multiples (such as three links, five links, six links, etc.) of the links to create assembled platforms. It should also be understood that the present invention does not require that all of the links be identical, although it is preferred for obvious reasons. FIGS. 8–10 provide some examples of such alternate embodiments that fall within the scope of the invention.

Figure 8B:
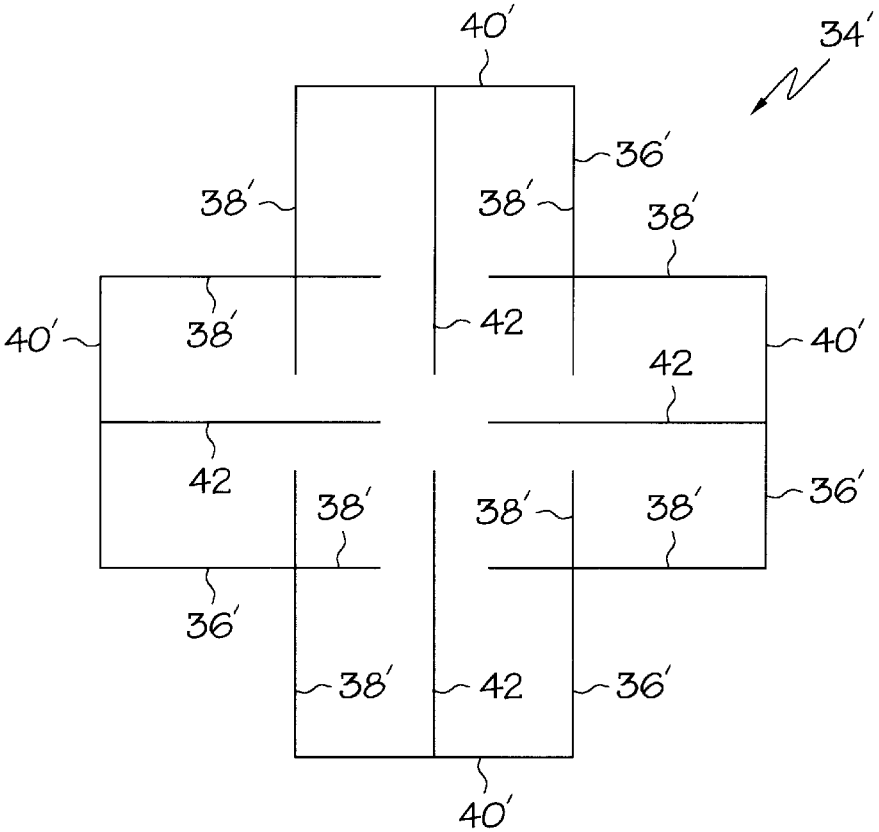
FIGS. 8A–8D provide schematic views of an example of an alternate embodiment of the present invention.
Figure 8A:
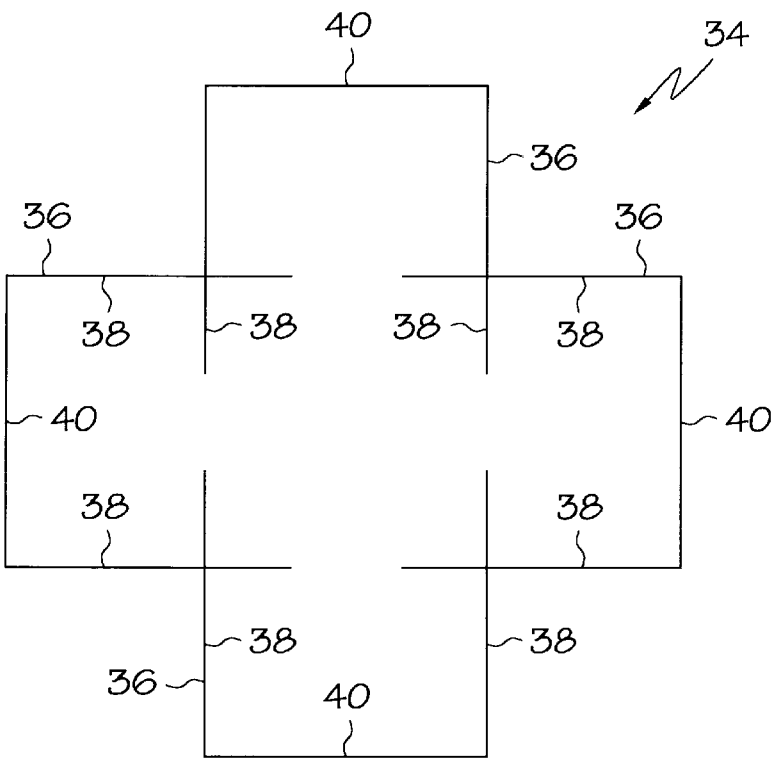
Figure 8D:
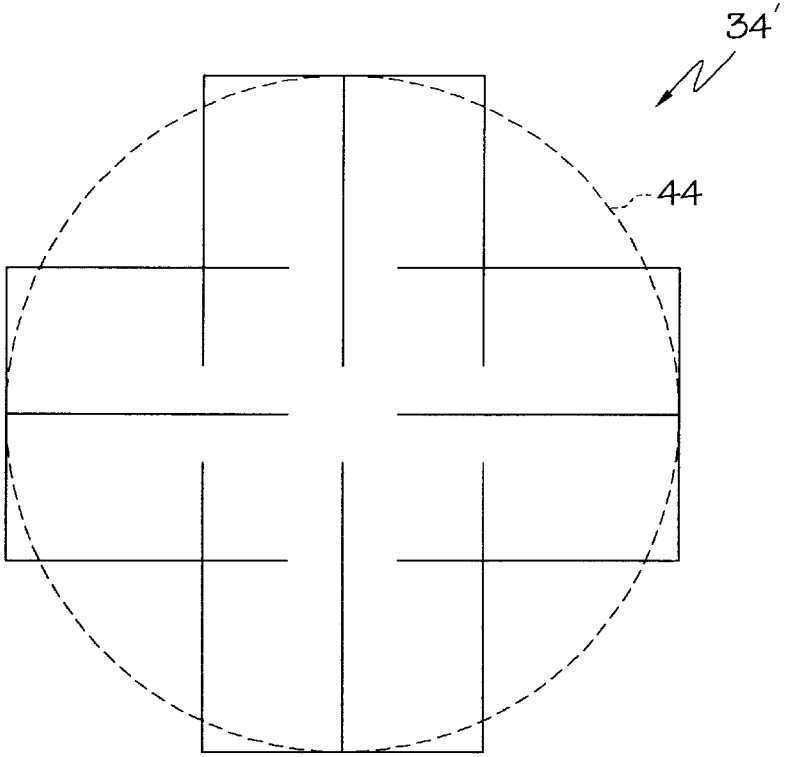
Figure 8C:
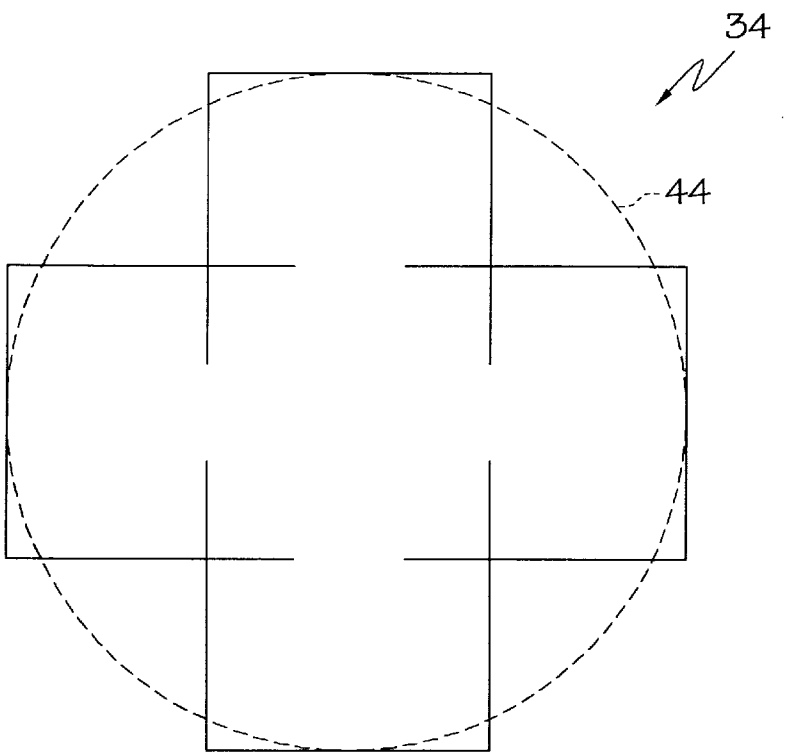

FIG. 8A shows an overhead view of an adjustable platform 34 having four links 36 where each link includes two elongated 38 linkage legs connected at a right angle to the base portion 40. FIG. 8B shows an overhead view of an adjustable platform 34' having four links 36', similar to those used in FIG. 8A with each link 36' being modified by the addition of an elongated support leg 42, the support leg being attached to the midpoint of base portion 40'. FIG. 8C depicts the same platform 34 shown in FIG. 8A, illustrating a potted plant 44 as it might rest on the platform 34. FIG. 8D depicts the same platform 34' shown in FIG. 8B, illustrating a potted plant 44 as it might rest on the platform 34'.

Figure 9B:
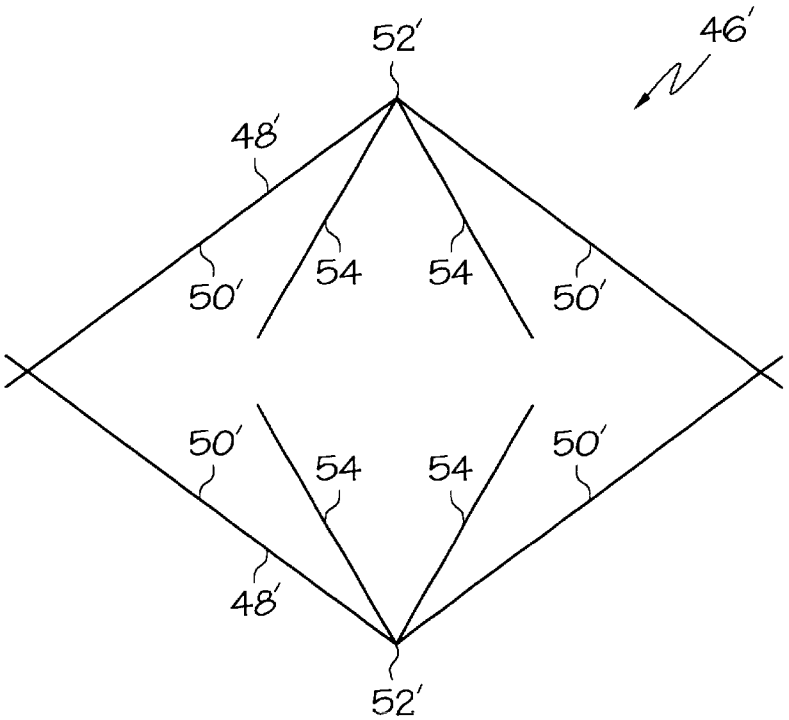
FIGS. 9A–9D provide schematic views of another example of an alternate embodiment of the present invention.
Figure 9A:
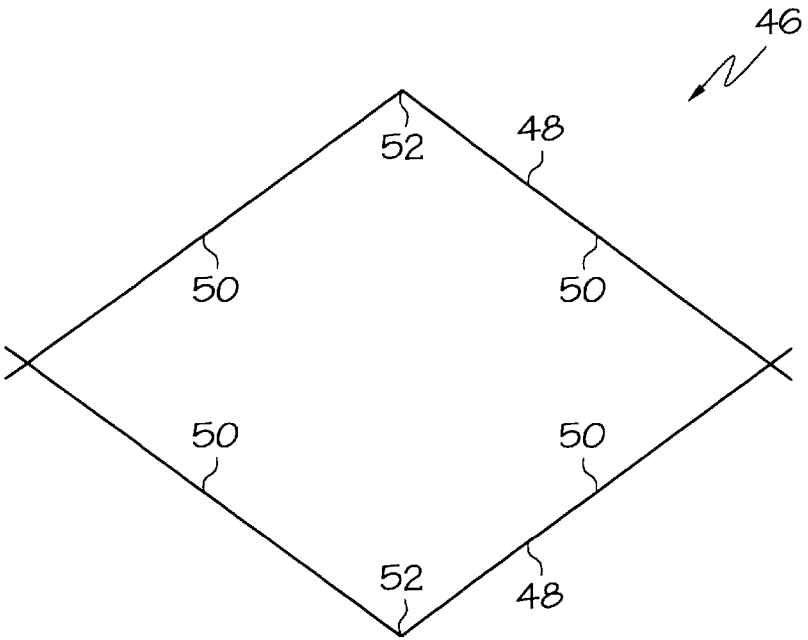
Figure 9D:
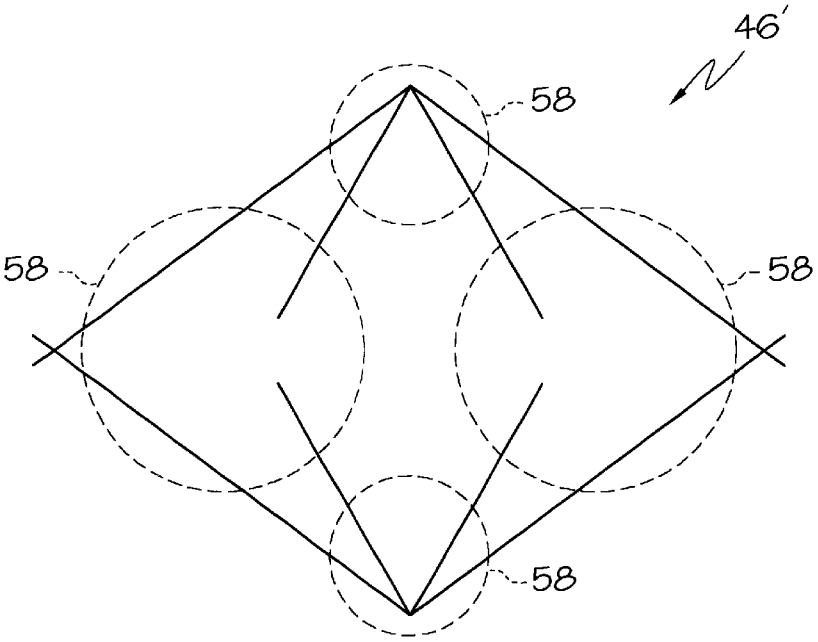
Figure 9C:
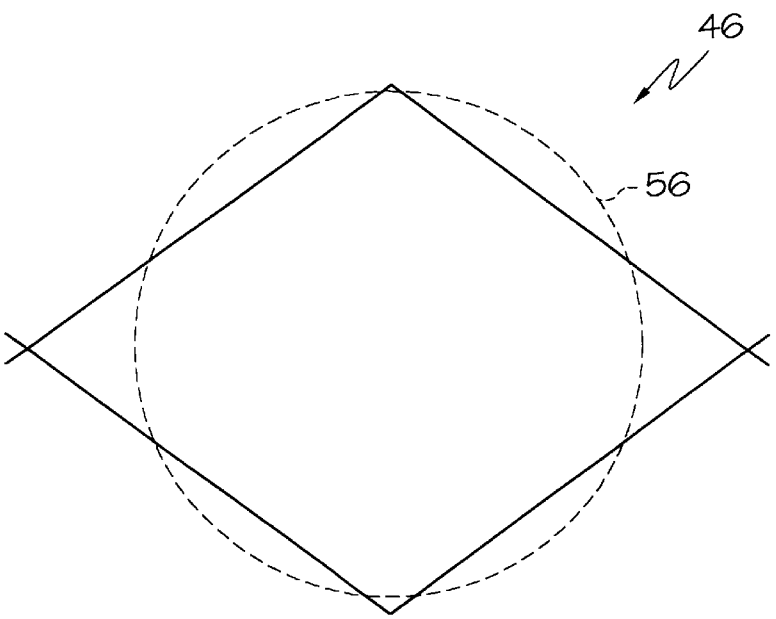

FIG. 9A shows an overhead view of an adjustable platform 46 having two links 48, each link having two elongated linkage legs 50 connected at a obtuse angle to the base portion 52. FIG. 9B shows an overhead view of an adjustable platform 46' having two links 48', similar to those used in FIG. 9A with each link 48' being modified by the addition of a pair of elongated support legs 54, the support legs 54 extending between the linkage legs 50', from the midpoint of base portion 52'. FIG. 9C depicts the same platform 46 shown in FIG. 9A, illustrating a potted plant 56 as it might rest on the platform 46. FIG. 9D depicts the same platform 46' shown in FIG. 9B, illustrating a number of different-sized potted plants 58 as they might rest on the platform 46', thereby illustrating the versatility and adaptability of the adjustable platform of the present invention.

Figure 10B:
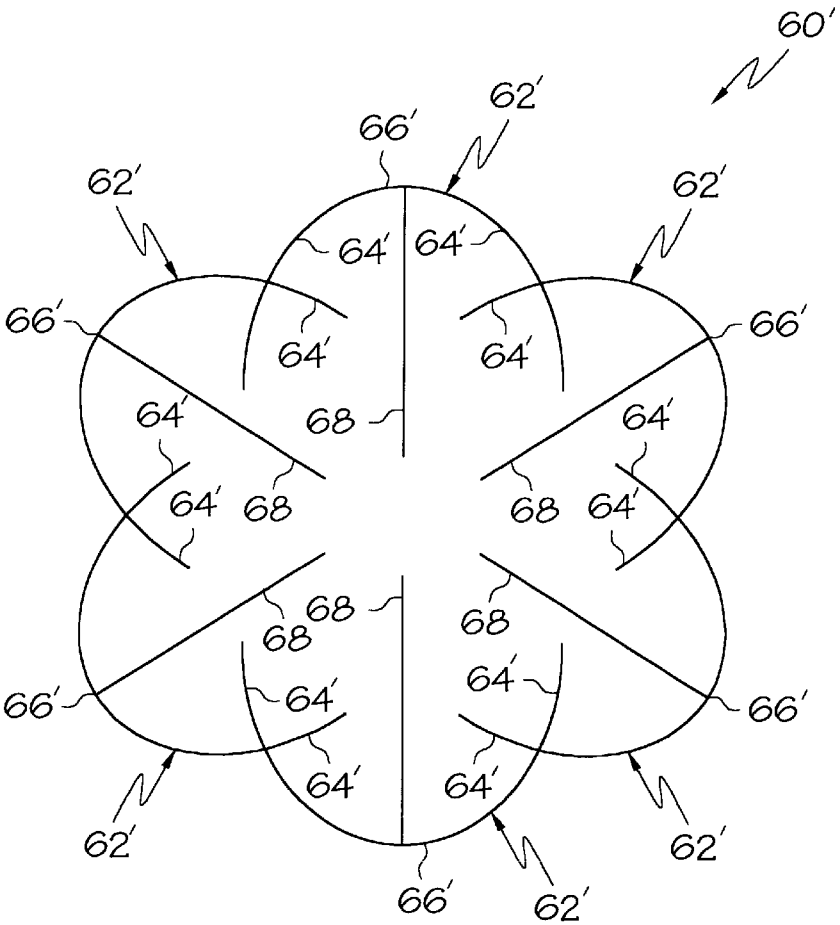
FIGS. 10A–10D provide schematic views of another example of an alternate embodiment of the present invention.
Figure 10A:
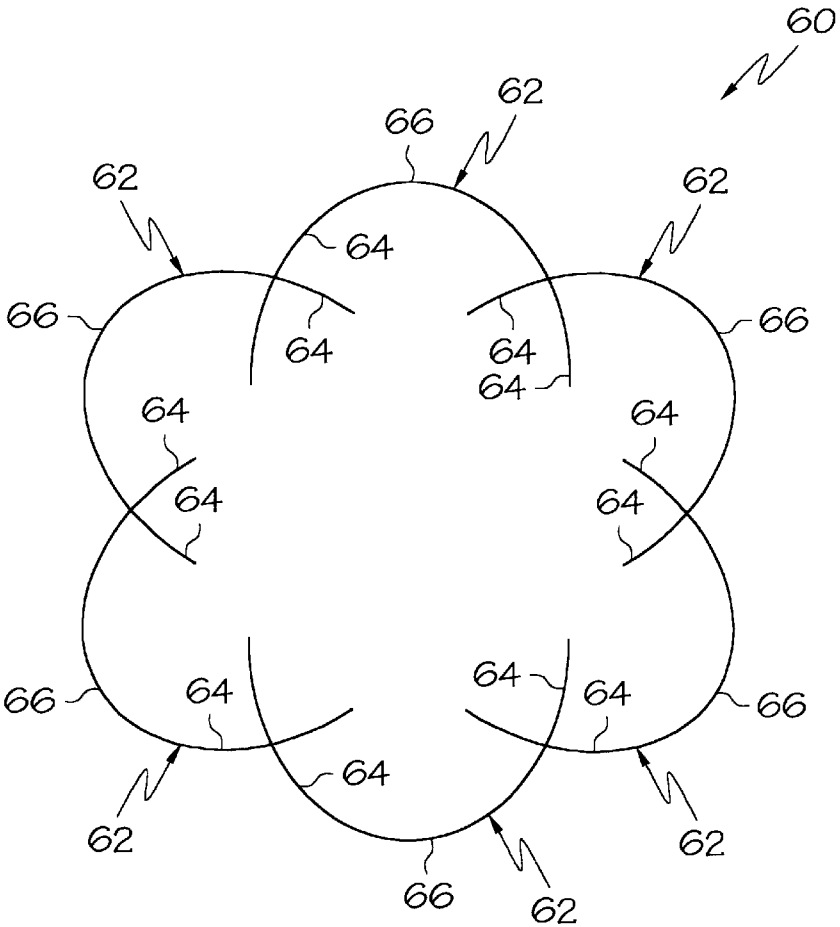
Figure 10D:
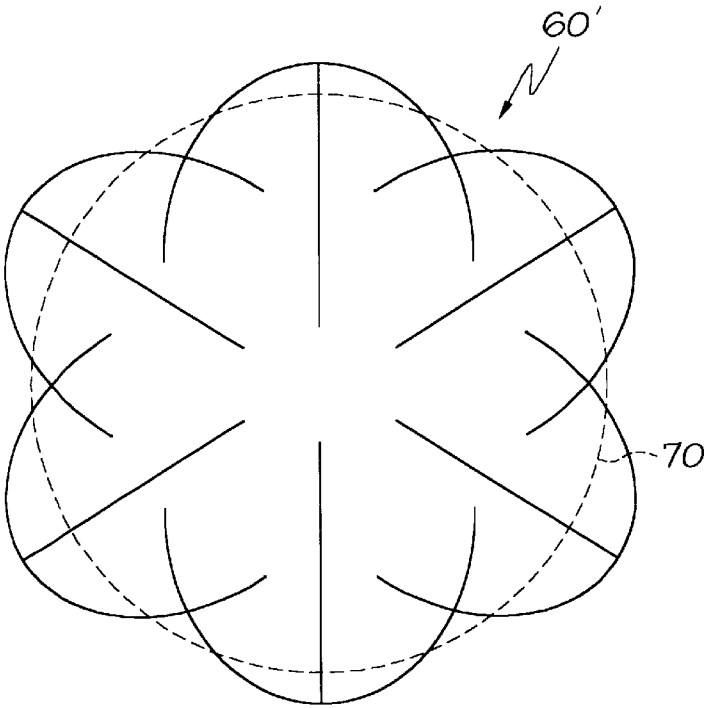
Figure 10C:
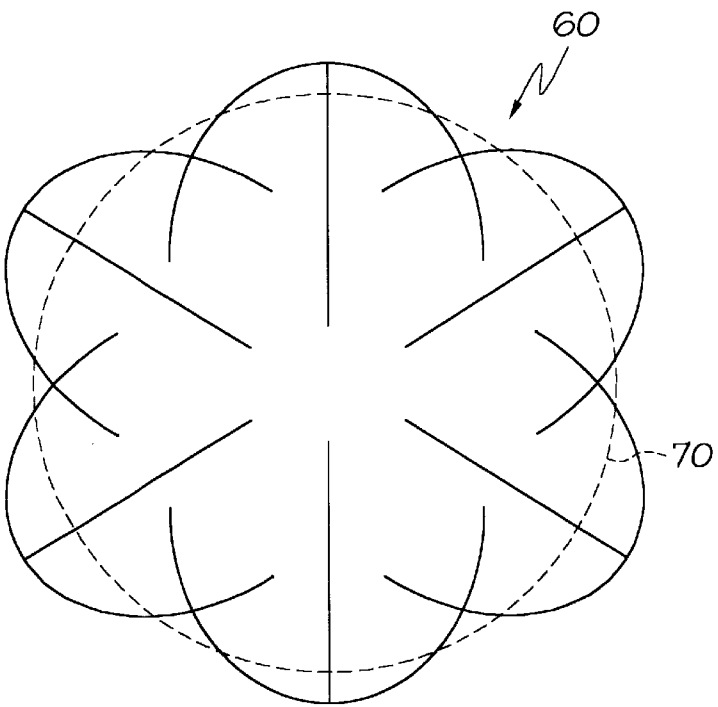

FIG. 10A shows an overhead view of an adjustable platform 60 having six links 62 where each link includes two elongated linkage legs 64 connected to form an arc with the base portion 66. FIG. 10B shows an overhead view of an adjustable platform 80' having six links 62', similar to those used in FIG. 10A with each link 62' being modified by the addition of an elongated support leg 68, the support leg 68 being attached to the midpoint of base portion 66' and extending between the linkage legs 64'. FIG. 10C depicts the same platform 60 shown in FIG. 10A, illustrating a potted plant 70 as it might rest on the platform 60. FIG. 10D depicts the same platform 60' shown in FIG. 10B, illustrating a potted plant 70 as it might rest on the platform 60'.

While the apparatuses and processes herein described in the above description and summaries constitute exemplary embodiments of the present invention, it is to be understood that the invention is not limited to these precise apparatuses and processes, and that changes may be made therein without departing from the scope of the invention as defined by the claims. Additionally, it is to be understood that the invention is defined by the claims and it is not intended that any limitations or elements describing the exemplary embodiments herein are to be incorporated into the meaning of the claims unless such limitations or elements are specifically listed in the claims.

What is claimed is:

1. An adjustable protective platform for supporting, potted plants, comprising:

a plurality of multi-legged links;

each link including a pair of linkage legs angled with respect to each other at an acute angle;

each linkage leg having an upper surface, a lower surface, an outer side, an inner side, an outer end and an origin end and each linkage leg including, a plurality of projections extending from the upper and lower surfaces; and at least two slots cut into the upper surface, extending from the outer side to the inner side, and angled at least partially towards the origin end of the opposite linkage leg, the slots in each linkage leg being symmetrical with respect to the slots in the opposite linkage leg.

2. The adjustable protective platform of claim 1, wherein the links are coupled together by arranging the links in an alternating up and down fashion so that the linkage legs form an outer enclosed loop, wherein the links are coupled together by engaging the slot in a linkage leg of an upwardly facing link with the slot in an immediately adjacent linkage leg of an adjacent downwardly facing link.

3. The adjustable protective platform of claim 2, wherein each link includes at least one additional leg extending between the pair of linkage legs, each additional leg also having a plurality of projections extending from its upper and lower surfaces.

4. An adjustable protective platform for supporting and aerating, potted plants, the platform comprising:

at least two links;

each link including at least two outer linkage legs joined together by a base portion, each outer linkage leg having an upper surface, a lower surface, an outer side surface, an inner side surface, an outer end and an origin end, the origin end connected to the base portion of the link; and each outer linkage leg including at least one fastener for coupling to an immediately adjacent outer linkage leg of an adjacent link.

5. The adjustable protective platform of claim 4, wherein each outer linkage leg includes a plurality of projections extending from the upper and lower surfaces.

6. The adjustable protective platform of claim 4, wherein each outer linkage leg includes at least two of the fasteners, a first one of the fasteners being relatively proximal to the base portion and a second one being relatively distal from the base portion.

7. The adjustable protective platform of claim 6, wherein the fasteners are slots cut into the upper surface of each outer linkage leg, extending from the outer side surface to the inner side surface.

8. The adjustable protective platform of claim 7, wherein the slots in each outer linkage leg are symmetrical with respect to the slots in the opposite linkage leg.

9. The adjustable protective platform of claim 8, wherein the links are coupled together by arranging the links in an alternating up and down fashion so that the outer linkage legs form an outer enclosed loop via mutual interfacing of the slot in an outer linkage leg of an upwardly facing link with the slot in an immediately adjacent outer linkage leg of an adjacent downwardly facing link.

10. The adjustable protective platform of claim 9, wherein each linkage leg includes scribe lines either etched or molded into the inner and outer side surfaces of each outer linkage leg and located nearest the outer end of each outer linkage leg, the scribe lines designed to allow the user to permanently detach the outer end of each outer linkage leg when a smaller area is desired for the platform.

11. The adjustable protective platform of claim 10, wherein each link includes at least one support leg extending from the base portion between the outer linkage legs, each support leg having an upper surface, a lower surface, two lateral surfaces, an outer end and an origin end, the origin end proximate the base portion of the link.

12. The adjustable protective platform of claim 11, wherein each support leg includes a plurality of projections extending from its upper and lower surfaces.

13. The adjustable protective platform of claim 12, wherein each support leg includes scribe lines either etched or molded into the lateral surfaces of each support leg and located nearest the outer end of each support leg, the scribe lines designed to allow the user to permanently detach the outer end of each support leg when a smaller area is desired for the platform.

14. The adjustable protective platform of claim 7, wherein the slots include symbols representing the relative size of the adjustable protective platform that would be provided if the slots were used to couple the links together.

15. A link of an adjustable protective platform for supporting and aerating, potted plants, the link comprising:

a base portion having an upper surface and a lower surface and at least one projection extending upwardly from each of the upper and lower surfaces; and a pair of elongated linkage legs extending less than 180° with respect to one another from the base portion, each of the elongated linkage legs having an upper and a lower surface, and each of the elongated linkage legs including at least one projection extending upwardly from each of the upper and lower surfaces and at least one fastener positioned relatively distal from the base portion, adapted to be releasably coupled to the linkage leg of another link.

16. The link of claim 15 wherein:

each of the linkage legs include an outer side surface and an inner side surface; and the fastener is a slot present in the upper surface, extending from the outer side surface to the inner side surface and angled at least partially towards the base portion.

17. The link of claim 16 wherein:

the pair of linkage legs are angled at approximately 60° with respect to one another from the base portion; and the slot is angled at approximately 60° from a centerline extending between the two linkage legs.

18. A method for adjusting the support area of a platform for supporting and aerating, potted plants, the method comprising the steps of:

(a) providing at least two links, where each link includes a pair of linkage legs extending from an origin portion of the link, each linkage leg including at least two transverse slots;

(b) arranging the links in an alternating up and down fashion;

(c) overlapping the linkage leg of an upwardly facing link with the linkage leg of an immediately adjacent downwardly facing link at a point that will create the desired area for the platform;

(d) ensuring that overlapping linkage legs are fastened together via the mutual interfacing of the symmetrical slots located on each linkage leg; and (e) repeating steps (b) through (d) until all of the links are fastened together via the linkage legs to form an outer enclosed loop.

19. The method for adjusting the support area of a platform for supporting and aerating, potted plants, the method comprising the steps of:

(a) providing at least two links made from a resilient material, where each link includes a pair of linkage legs extending from an origin portion of the link at approximately 60° with respect to one another, each linkage leg including at least two transverse slots angled at approximately 60° from a centerline extending between the two linkage legs;

(b) arranging the links in an alternating up and down fashion;

(c) overlapping the linkage leg of an upwardly facing link with the linkage leg of an immediately adjacent downwardly facing link at a point that will create the desired area for the platform;

(d) lightly squeezing the outer ends of the linkage legs inward (e) ensuring that overlapping linkage legs are fastened together via the mutual interfacing of the symmetrical slots located on each linkage leg;

(f) releasing the outer ends of the linkage legs thereby creating a holding tension in the links due to the elasticity of the resilient material; and (g) repeating steps (b) through (f) until all of the links are fastened together via the linkage legs to form an outer enclosed loop.

* * * * *